United States Patent [19]

Larkin et al.

[11] Patent Number: 4,547,900

[45] Date of Patent: Oct. 15, 1985

[54] FLEXIBLE CONTAINER WITH INTEGRAL PORTS AND DIAPHRAGM

[75] Inventors: Mark E. Larkin, Lindenhurst; Leonard J. Meyer, Antioch, both of Ill.

[73] Assignee: Abbott Laboratories, North Chicago, Ill.

[21] Appl. No.: 186,782

[22] Filed: Sep. 12, 1980

Related U.S. Application Data

[63] Continuation-in-part of Ser. No. 106,954, Dec. 26, 1979, Pat. No. 4,313,904.

[51] Int. Cl.[4] ..... B65D 41/32

[52] U.S. Cl. ..... 383/5; 604/408; 206/628; 220/266; 215/249

[58] Field of Search ..... 604/408, 415; 206/628; 220/266, 270, 276; 215/249, 247; 383/5

[56] References Cited

U.S. PATENT DOCUMENTS

| | | | |
|---|---|---|---|
| 1,431,871 | 10/1922 | Burnet . | |
| 3,325,031 | 6/1967 | Singier . | |
| 3,358,062 | 12/1967 | Lemelson | 264/96 |
| 3,479,421 | 11/1969 | Armbruster et al. | 264/98 |
| 3,554,256 | 1/1971 | Anderson | 150/8 |
| 3,705,931 | 12/1972 | Confer et al. | 264/89 |
| 3,742,995 | 7/1973 | Confer et al. | 150/5 |
| 3,805,986 | 4/1974 | Gaudin | 215/31 |
| 3,810,503 | 5/1974 | Lewis et al. | 150/8 |
| 3,851,029 | 11/1974 | Cornett et al. . | |
| 3,915,212 | 10/1975 | Bujan et al. | 150/8 |
| 3,919,374 | 11/1975 | Komendowski | 264/90 |
| 3,936,264 | 2/1976 | Cornett, III et al. | 425/326 B |
| 3,994,412 | 11/1976 | Difiglio | 150/8 X |
| 4,049,033 | 9/1977 | Ralston | 105/5 |
| 4,176,153 | 11/1979 | Weiler et al. | 264/524 |
| 4,313,904 | 2/1982 | Larkin et al. | 53/452 X |

FOREIGN PATENT DOCUMENTS 452960 9/1974 Australia .

*Primary Examiner*—Donald F. Norton
*Attorney, Agent, or Firm*—Robert S. Beiser; Neil E. Hamilton; Alan R. Thiele

[57] ABSTRACT

A container for liquids, preferably sterile liquids comprises a hollow body constructed of plastic material having a plurality of tubular ports integrally formed and extending therefrom. Each port has a quantity of plastic material integrally formed as a diaphragm within the port so as to seal the container. In a preferred embodiment, at least one of the ports has a resealable septum sealed within it. The diaphragm is positioned between the septum and the liquid within the container so as to prevent deterioration of the resealable septum caused by exposure to the liquid. Both the resealable septum and the diaphragm are constructed of a material which is penetrable by a hypodermic needle for use in administering sterile solutions. A removable twist cap is integrally formed about and seals the end of each tubular port.

13 Claims, 16 Drawing Figures

FLEXIBLE CONTAINER WITH INTEGRAL PORTS AND DIAPHRAGM

BACKGROUND OF THE INVENTION

The present invention is a continuation-in-part of U.S. Ser. No. 106,954 filed Dec. 26, 1979, now U.S. Pat. No. 4,313,904 and relates generally to containers for liquids, and in particular, to containers for liquid medicinal products, such as for example, intravenous solutions such as electrolytic or other solutions, plasma substitute solutions, anticoagulant solutions, blood or plasma and derivatives.

Plastic molded containers have found increasing acceptance in recent years and are used extensively throughout the packaging field. They are relatively inexpensive, lighter in weight, durable and resist degradation from the liquids they contain. In the medical field, a particularly wide acceptance has been found for flexible containers used for dispensing liquids such as intravenous solutions. A continuing problem exists, however, in reducing the manufacturing costs of said containers. An additional problem has been the manufacture of such containers having a number of ports attached thereto for adding additional liquid to the container such as a medicament, and of sealing such ports.

The following patents are representative of attempts at solving such problems:

Australian Pat. No. 807,759 filed Mar. 17, 1969 "Sealed Bag for Liquids"—David Bellamy, Jr., et al.;

U.S. Pat. No. 1,431,871 granted Oct. 10, 1922—"Bottle and Like Closing Device"—Edward Purnet;

U.S. Pat. No. 3,325,031 granted June 13, 1967—"Bottles of Flexible Material for Medicinal Products"—J. L. G. Singier;

U.S. Pat. No. 3,358,062 granted Dec. 12, 1967—"-Molding Method for Making Sealed Articles"—Jerome H. Lemelson;

U.S. Pat. No. 3,919,374 granted Nov. 11, 1975 "Method for Blow Molding a Container Having an Auxiliary Component Formed as an Integral Part of It"—Henry Komendowski;

U.S. Pat. No. 3,479,421 granted Nov. 18, 1969 "Method of Molding Hollow Bodies"—Fritz Armbruster, et al.;

U.S. Pat. No. 3,705,931 granted Dec. 12, 1972 "Method for Blow Molding and Compression Molding Thermoplastic Material"—R. C. Confer, et al.;

U.S. Pat. No. 3,742,995 granted July 3, 1973—"Blow Molded Article of Thermoplastic Material Having a Threaded Insert Therein"—R. C. Confer, et al.

U.S. Pat. No. 3,805,986 granted Apr. 23, 1974—"-Containers"—Jean Joseph Gaudin;

U.S. Pat. No. 3,810,503 granted May 14, 1974—"-Variable Volume Container for Fluids"—Dan Lewis, Jr., et al.

U.S. Pat. No. 3,851,029 granted Nov. 26, 1974 "Method for Molding and Sealing Thermoplastic Containers"—W. G. Cornett III, et al.;

U.S. Pat. No. 3,936,264 granted Feb. 3, 1976 "Apparatus for Blow Molding a Container with Breachable Sealing Members"—W. G. Cornett III;

U.S. Pat. No. 4,049,033 granted Sept. 20, 1977 "Molded Collapsible Solution Container"—Philip G. Ralson, Jr.;

U.S. Pat. No. 4,176,153 granted Nov. 27, 1979 "Unitary, Hermetically-Sealed But Pierceable Dispensing Container"—G. H. Weiler, et al.

Accordingly, it is an advantage of the present invention to provide a container for liquids which is low cost and easy to manufacture, which has a number of tubular ports integrally formed and extending therefrom during the same forming process as the container itself, and which has a diaphragm integrally formed in each tubular port so as to separate the liquid contained within the container from a resealable septum within the tubular port, thereby preventing deterioration of the septum.

SUMMARY OF THE INVENTION

The present invention is a container for liquids comprising a hollow body formed of plastic material. A number of tubular ports, preferably two, are integrally formed in and extend from the hollow body. Each port has a diaphragm integrally formed within it, formed from the same plastic material.

In a preferred embodiment each tubular port also contains a resealable septum sealed within the port. The diaphragm is positioned between the resealable septum and the liquid within the container so as to prevent deterioration of the resealable septum from exposure to the liquid. The resealable septum and the diaphragm are both constructed of a material which allows penetration by a hypodermic needle. The resealable septum, preferably constructed of a rubber compound, is designed to reseal itself upon removal of the hypodermic needle.

In a preferred embodiment the resealable septum is positioned within the tubular port during formation of the container, so as to provide improved seal characteristics between the septum and the tubular port. The container is blow-molded in the shape of a flexible bag, particularly adapted for dispensing sterile solutions. In such an embodiment, the bag is formed as a hollow body which is substantially tubular in shape, tapering at one end to a hanging portion and having at least one tubular port at a second end. The bag is adapted for hanging vertically and dispensing liquid from the container through the tubular port. Along these same lines the shape of the container and the material selected effectively cause the bag to collapse uniformly from top to bottom upon dispersal of the liquid from the container. Thus, the invention is particularly well adapted for use in sterilization and sterility maintaining packaging. An additional means of ensuring such sterility is the use of an overcap over each tubular port so as to prevent contamination of the port after sterilization and before penetration by a hypodermic needle.

It is the primary advantage of the present invention over parent application Ser. No. 106,954, now U.S. Pat. No. 4,313,904 to provide a container having a removable twist cap integrally formed about and sealing the end of one or more tubular ports. In a preferred embodiment, the overcap is a removable twist cap integrally formed about and sealing the ends of the tubular ports. A frangible groove circumscribes the port and allows the cap to be broken away when entry is required. In order to prevent contact between and consequent contamination of a hypodermic needle or a piercing pin during entry to the bag, an enlarged flange may be integrally formed between the tubular port and the overcap. A tab may also be formed on the overcap to facilitate removal of the cap from the port.

In an alternative embodiment of the invention the previously mentioned overcap may comprise a tube insertable into the tubular port. The tube is closed at one end, preferably the outside end, to prevent contamination, and may be closed by a penetrable plug, overcap, or a rigid plug or overcap. The tube may be removable, if desired, preferably by a tab or tabs attached to the overcap.

The invention also comprises a method of manufacturing a flexible plastic container for sterile solutions having at least one tubular port integrally formed therein. Conventional blow-molding of a plastic material for sterile solutions comprises the steps of extruding a parison of heated plastic material into a mold having portions shaped as a hollow cavity and tubular ports. The parison is then blown into the shape of the mold. Parent application Ser. No. 106,954 represents an improvement over conventional technology in the additional steps of inserting a pair of diaphragm pins into the lower portion of the parison for each tubular port desired. In a preferred embodiment the diaphragm pins are coaxially aligned, one inside and one outside of the parison. A portion of the heated plastic material is squeezed into the portion of the mold shaped as each tubular port. Part of the heated plastic is retained across the opening of that portion of the mold shaped as a tubular port, thus forming a diaphragm isolating the port from the remainder of the container. The material is then cooled sufficiently to retain the shape of the mold, the diaphragm, and each of said ports. The diaphragm pins are then retracted and the container is removed from the mold.

In a preferred embodiment, the previously mentioned ports are formed with resealable septums integrally formed therein. This is accomplished by affixing a septum to each diaphragm pin positioned outside the parison before insertion into the parison. A tubular port and diaphragm are then formed about each resealable septum. The septum is then released from the diaphragm pin after cooling of the container. One means of affixing the septum to the diaphragm pin is by using a point on the end of the pin which is adapted for puncturing the septum sufficiently to affix and retain it during the manufacturing process. This allows simplified, low cost manufacture.

In a preferred embodiment, once the diaphragm pins have been removed, the tube may be compressed into an overcap. In addition, by constructing the outside diaphragm pins with an enlarged diameter and providing a correspondingly shaped portion of the mold, an enlarged flange may be constructed between the tubular port and the overcap. Alternatively, the overcap itself may be increased in size. In either case, a frangible groove may be incorporated into the tubular port or the enlarged flange by including a correspondingly shaped bead in the tubular port sections of the mold. After formation of the diaphragm in the tubular ports the container may be blown, filled and sealed within the mold in a sterile condition, due to the heated condition of the plastic during formation.

DETAILED DESCRIPTION OF A PREFERRED EMBODIMENT

Figure 1:
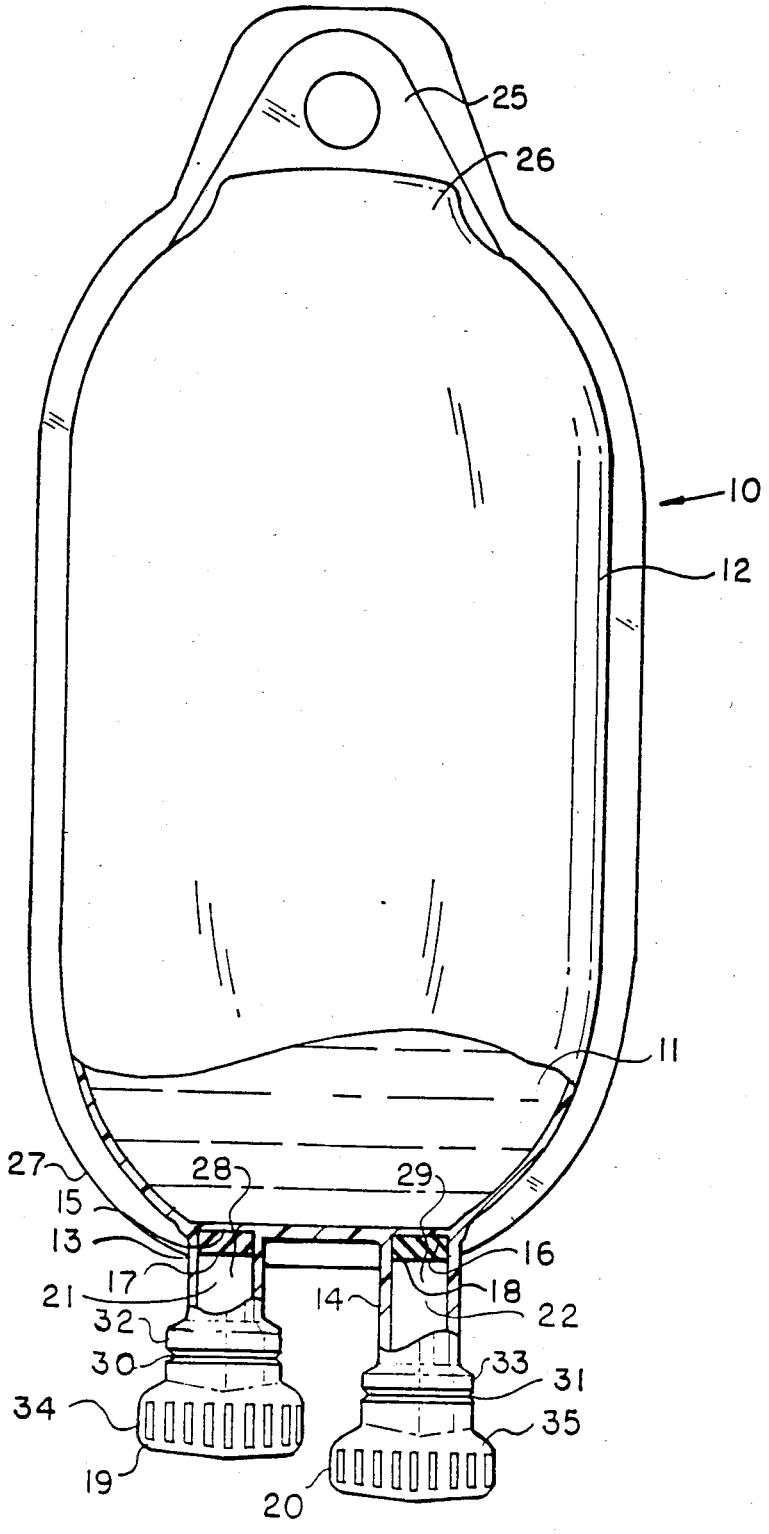
FIG. 1 of the drawings is a front view, partially cutaway, of a container for liquids having a pair of tubular ports integrally formed and extending therefrom, and a removable twist cap, integrally formed about the end of each tubular port.
Figure 2:
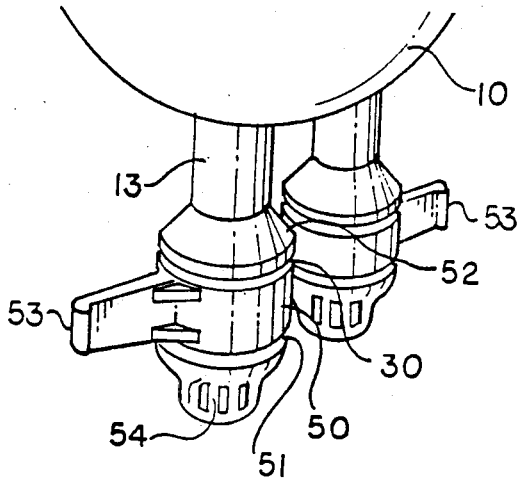
FIG. 2 of the drawings is a perspective view of an alternative embodiment of the previously mentioned twist cap.

While this invention is susceptible of embodiment in many different forms, there is shown in the drawings and will herein be described in detail, several specific embodiments, with the understanding that the embodiments illustrated are an exemplification of the principles of the invention, and are not intended to limit the invention to the embodiment illustrated.

Container 10 for liquid 11 comprises a hollow body 12 formed of plastic material such as polyethylene, polypropylene, polyvinylchloride or other commonly known plastics. Hollow body 12 has tubular ports 13 and 14 integrally formed and extending therefrom. Formed within tubular ports 13 and 14 are diaphragms 15 and 16 which seal ports 13 and 14 from hollow body 12 and correspondingly seal liquid 11 from the atmosphere.

In a preferred embodiment tubular ports 13 and 14 contain resealable septums 17 and 18 which are fixedly attached and sealed therein. Septums 17 and 18 are formed preferably of butyl rubber, silicone rubber, or other commonly known elastomers. Diaphragms 15 and 16 are positioned between septums 17 and 18 and liquid 11 so as to prevent deterioriation of septums 17 and 18 from exposure to liquid 11. Septums 17 and 18 as well as diaphragm 15 and 16 are adapted for penetration by a hypodermic needle (not shown). In addition, septums 17 and 18 are adapted to reseal themselves upon withdrawal of the hypodermic needle. In a preferred embodiment resealable septums 17 and 18 are positioned within tubular ports 13 and 14 during the formation of container 10 so as to provide improved sealing characteristics between septums 17 and 18 and tubular ports 13 and 14. Thus, in a preferred embodiment container 10 is both sterilizable and sterility maintaining in order to contain sterile solutions. Along these same lines, in a preferred embodiment container 10 includes overcaps 19 and 20 affixed to tubular ports 13 and 14. Overcap 19 is designed to cover orifice 21 of tubular port 13. Similarly, overcap 20 is designed to cover orifice 22 of tubular port 14.

In a preferred embodiment container 10 and hollow body 12 are formed in a substantially tubular shape tapering to a hanger 25 at end 26. Tubular ports 13 and 14 are formed at end 27. As a result when container 10 is hung with hanger 25 in the uppermost position ports 13 and 14 below liquid 11 may be dispensed by gravity feed. In addition, hollow body 12 is constructed of material sufficiently elastic and is shaped so as to uniformly collapse from hanger portion 25 downward. In order to accomplish this, in a preferred manner, container 10 comprises a blow-molded bag constructed of such materials as plasticized polyvinylchloride polymers.

In the embodiment of the invention shown in FIG. 1, a plurality of twist cap members 19 and 20 are integrally formed about and seal the ends of tubular ports 13 and 14. Frangible grooves 30 and 31 circumscribe tubular ports 13 and 14 and may be broken so as to remove twist caps 19 and 20, thereby exposing orifices 21 and 22.

An additional feature of the invention is the formation of enlarged flanges 32 and 33 at the distal ends of tubular ports 13 and 14. Twist caps 19 and 20 are attached to enlarged flanges 32 and 33. Although twist caps 19 and 20 are shown as integrally formed and extending from enlarged flanges 32 and 33, they may alternatively comprise twist caps threadedly attached thereto.

One embodiment of such a twist cap may be seen in FIG. 15 to be described below.

As further seen in FIG. 1, tabs 34 and 35 are integrally formed and extend from twist caps 19 and 20. These tabs are used to twist caps 19 and 20 thereby breaking frangible grooves 30 and 31, so that caps 19 and 20 may be removed.

Figure 4:
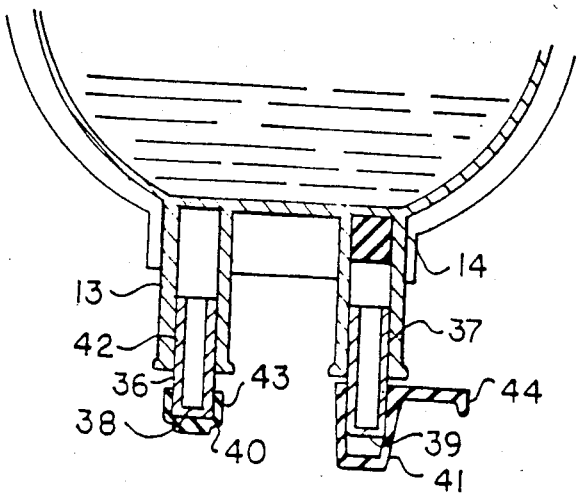
FIG. 4 of the drawings is a front view, partially cut away, of an alternative embodiment of a container for liquids having tubular cap members inserted into each tubular port.
Figure 5:
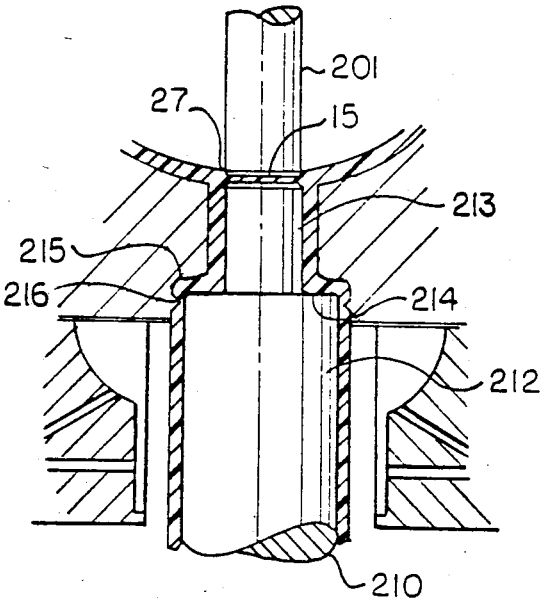
FIG. 5 of the drawings is a front view partially broken away of a portion of a mold used in the manufacture of the container of FIG. 1 showing in particular adjustable diaphragm pins used in the formation of a diaphragm within a tubular port.
Figure 6:
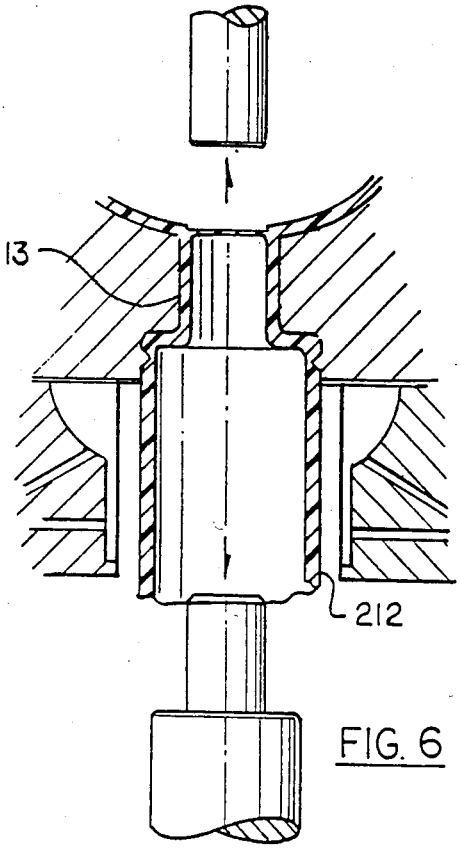
FIG. 6 of the drawings is a front view partially broken away of the adjustable diaphragm pins of FIG. 5 withdrawn from the mold.
Figure 7:
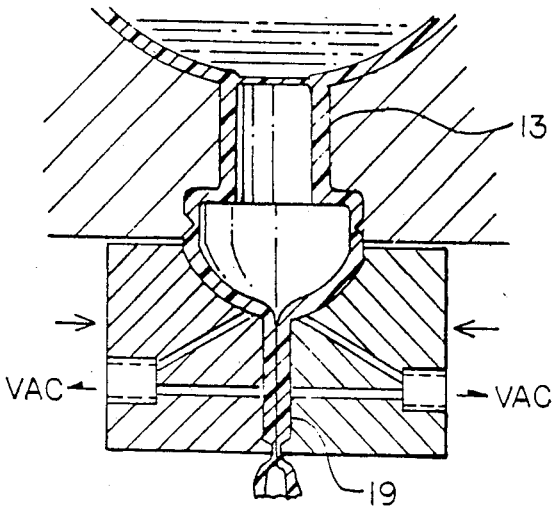
FIG. 7 of the drawings is a vertical section of the portion of the mold shown in FIGS. 5 and 6 showing in particular compression of the end of the tubular port so as to form the twist cap shown in FIG. 1.

In an alternative embodiment, as seen in FIG. 4, tubular ports 13 and 14 are sealed by means of tubular caps 36 and 37. Caps 36 and 37 are preferably closed at ends 38 and 39. Ends 38 and 39 may be closed by fusion, by insertion of a resealable plug (not shown), by use of a penetrable overcap 40, or by use of a rigid overcap 41 or plug. In any event, tubular cap members 36 and 37 generally comprise a first tubular member 42 slightly smaller in outside diameter than the inside diameter of tubular ports 13 and 14 so as to allow press-fitting and sealing therein.

First tubular member 42 may be sealed at its distal end by penetrable resealable elastomeric material in the shape of overcap 43, or an insertable plug (not shown). Alternatively, rigid overcap 41, may comprise a thermosetting material such as phenolic, urea, polypropylene carbonates or other commonly known plastics. A metallic cap may also be used if desired. As shown, overcap 41 includes a tab 44 used for grasping and removal. Overcap 43 may also include such a tab if desired.

Figure 3:
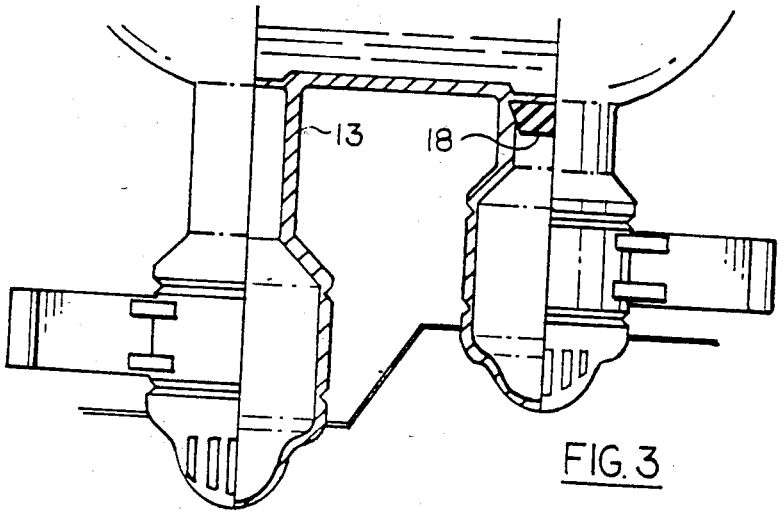
FIG. 3 of the drawings is a front view partially cut away of the twist caps disclosed in FIG. 2.

As best seen in FIGS. 2, 3 and 9–11, an alternate embodiment of twist cap 19 may comprise twist cap 50. Twist cap 50 includes frangible groove 30 and a second frangible groove 51. However, enlarged flange 52 is conical in shape. Tab 53 extends laterally from twist cap 50 and is used for twisting it, thereby severing frangible groove 30. Alternatively, tab 54 at the end of twist cap 50 may be used for severing frangible groove 51. As best seen in FIG. 3, tubular port 13 or 14 may contain a resealable septum embedded in diaphragm 16.

The invention also includes a method of manufacturing flexible container 10. As described in the parent application, Ser. No. 106,954 filed Dec. 26, 1979 (hereby incorporated by reference) and in FIG. 12 of the present applications, the conventional method of manufacturing a blow molded plastic container 100 comprises the steps of extruding a parison 101 of heated plastic material into a mold 102, blowing the parison 101 into the shape of the mold 102 utilizing a blow pipe 103, cooling container 100 and removing it from mold 102. Also known in the art is the formation of tubular ports (not shown) extending from container 100. Additionally taught in the prior art, as seen in U.S. Pat. No. 3,919,374, is the formation of a tubular port in a blow-molding process in which a rubber plug is introduced into the tubular port during the blow-molding process and the tubular ports are formed about the rubber plug.

Figure 12:
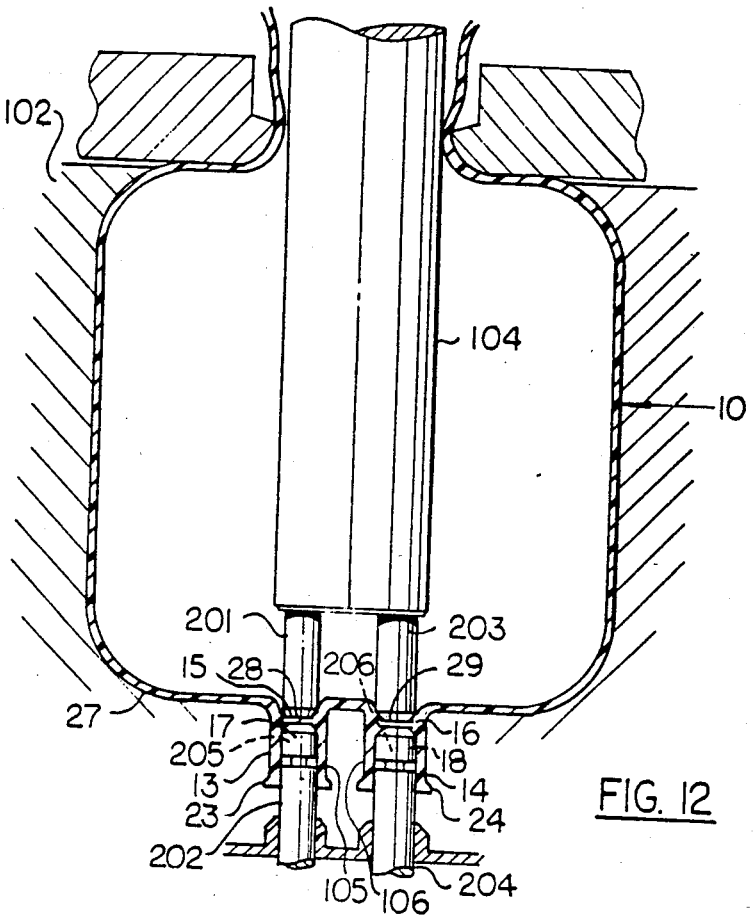
FIG. 12 of the drawings is a vertical section of the method of forming a container disclosed in patent application Ser. No. 106,954.
Figure 13:
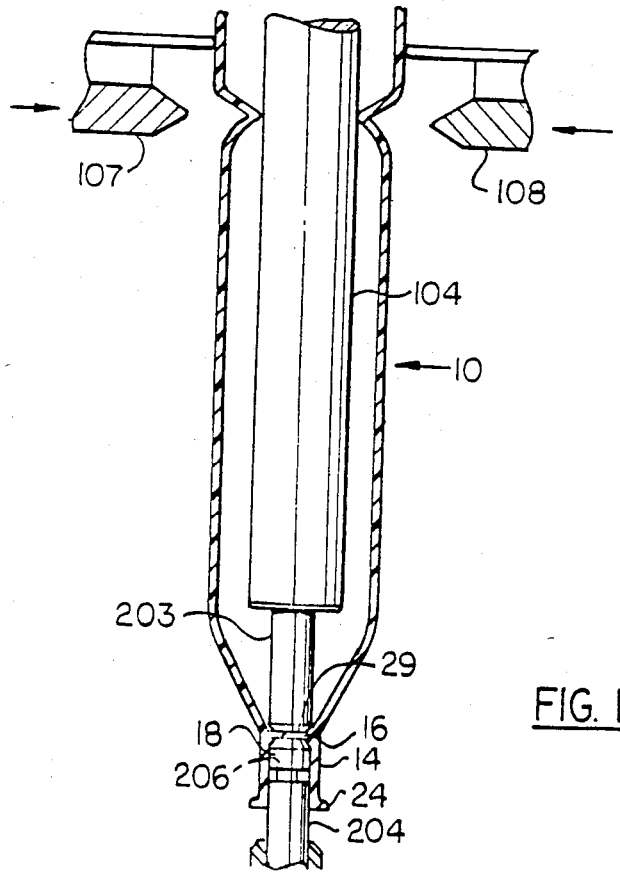
FIG. 13 of the drawings is a vertical section, taken from the side of the method disclosed in FIG. 12.

In the present invention, as seen in FIGS. 12 and 13 the drawings, after container 10 is extruded as a parison of heated plastic material into a mold 102, diaphragm pins 201, 202, 203 and 204 are used for forming container 10 and pins 202 and 204 are removed from tubular ports 13 and 14 leaving septums 17 and 18 remaining therein. Container 10 is then removed from the mold.

Figure 8:
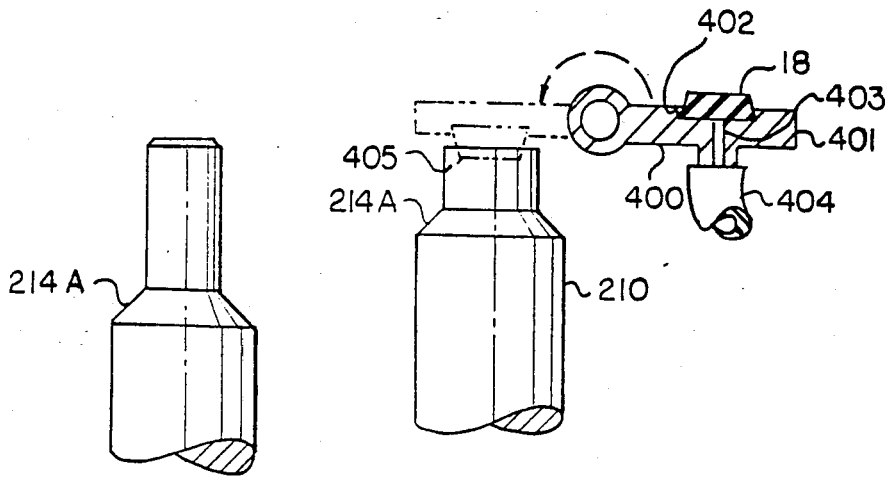
FIG. 8 of the drawings is a schematic representation of a method of loading the septum of FIGS. 5 and 6 onto an alternative diaphragm pin.
Figure 9:
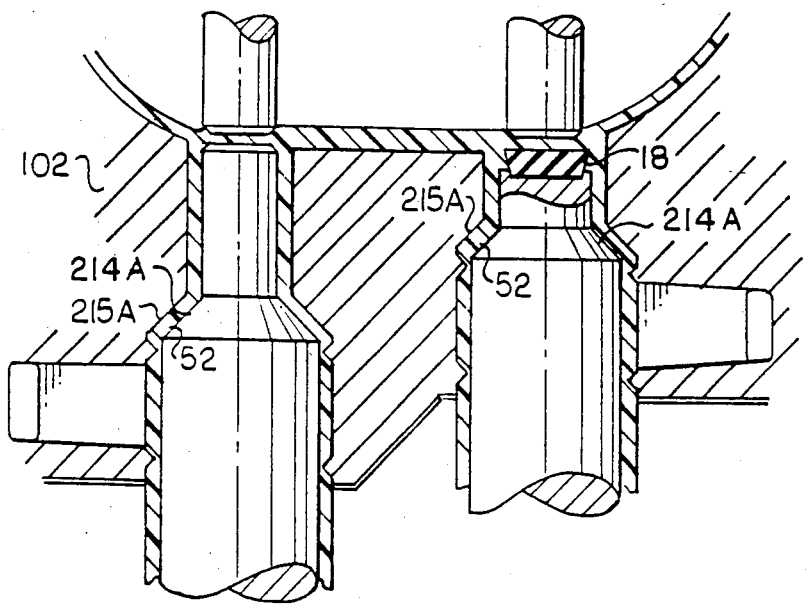
FIG. 9 of the drawings is a front view partially broken away of the adjustable diaphragm pins of FIG. 8 inserted into a pair of tubular ports.

FIG. 8 illustrates a method by which resealable septum 18 may be positioned on diaphragm pin 210. Vacuum transfer device 400 comprises a pivotal arm 401, positioned proximate mold 102, in which is found an aperture 402 shaped to receive resealable septum 18. An orifice 403 into aperture 402 is connected to a vacuum line 404 for selective retention of septum 18. Once septum 18 is in aperture 402, pivotal arm 401 is rotated so as to deposit septum 18 in aperture 405 at the top of diaphragm pin 210. Vacuum is then ceased and pivotal arm 401 rotated out of the way.

As further shown in FIG. 12 container 10 may be formed using blow pin 104 which is adapted either for blowing container 10 into shape within the mold or may additionally be adapted for filling container 10 with liquid 11 while in the mold. Blow pin 104 is then removed from container 10 and the top portion of container 10 is sealed using sealing knives 107 and 108 which seal the top portion 26 of container 10 and in a preferred embodiment, also form hanger 25 proximate to top portion 26.

The present application further discloses improvements in the method of closing the aforesaid tubular ports 13 and 14. The method of forming container 10 from a parison of heated plastic is essentially identical. However, as best seen in FIGS. 5 through 8, in the present invention, once the outside diaphragm pin 210 is removed the end 211 of tubular port 13 may be compressed so as to form twist cap 19 and thereby seal tubular port 13.

Outside diaphragm pin 210, which is preferably rod like in shape, includes proximal portion 212 and distal portion 213. Proximal portion 212 is larger in outside diameter than distal portion 213, and includes shoulder 214 where the two are joined. When outside diaphragm pin 210 is squeezed into end portion 27 of the plastic material at the bottom of container 10 in juxtaposition to inside diaphragm pin 201, diaphragm 15 is formed. In addition, shoulder 214 is aligned with, and positioned proximate to, enlarged portion 215 of mold 102. Enlarged flange 32 is thereby formed.

Portion 215 of mold 102 also includes a rim or bead 216 circumscribing section 105 of mold 102. Rim 216 forms a frangible groove 30 in enlarged flange 32. Frangible groove 30 may alternatively be formed in tubular port 13 if desired. In this regard, as indicated in the claims, enlarged flange 30 may be eliminated, if desired, and tubular port 13 simply compressed at its distal end to form an overcap.

Figure 10:
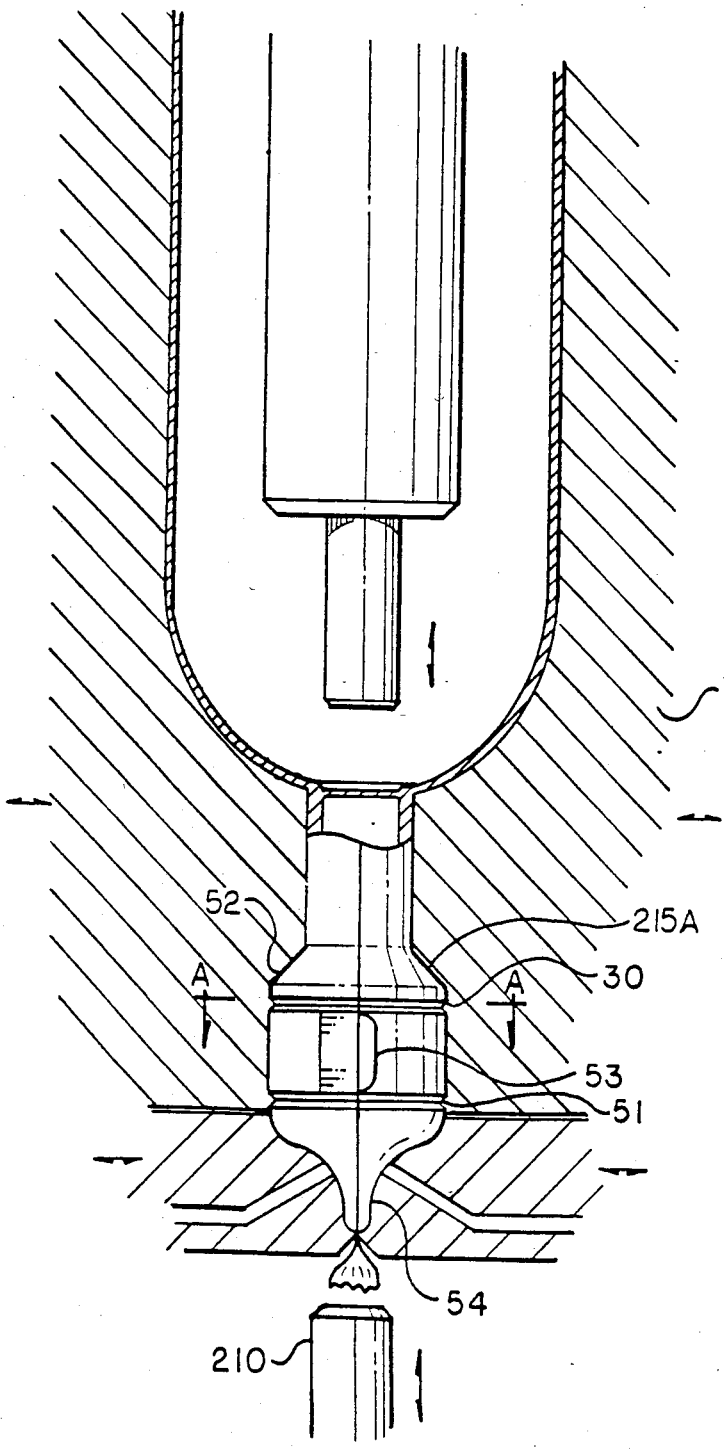
FIG. 10 of the drawings is a side view, partially broken away of the twist cap of FIG. 2 formed using the method disclosed in FIGS. 8 and 9.
Figure 11:
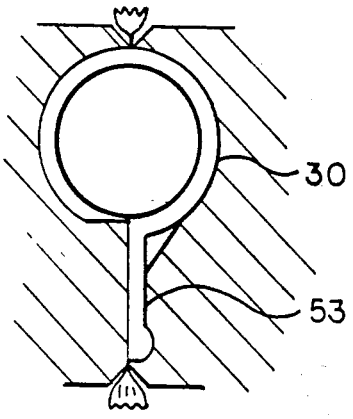
FIG. 11 is a sectional view taken along line A—A of the tubular port and mold therefor shown in FIG. 10.

FIGS. 8–11 illustrate the changes required in mold 102 to manufacture alternative twist cap 50. Outside diaphragm pin 210 has shoulder poprtion 214A formed in a conical configuration with corresponding portion 215A of mold 102 similarly shaped, (FIG. 10). Conical enlarged flange 52 is formed therebetween from plastic at the end 27 of container 10.

Figure 14:
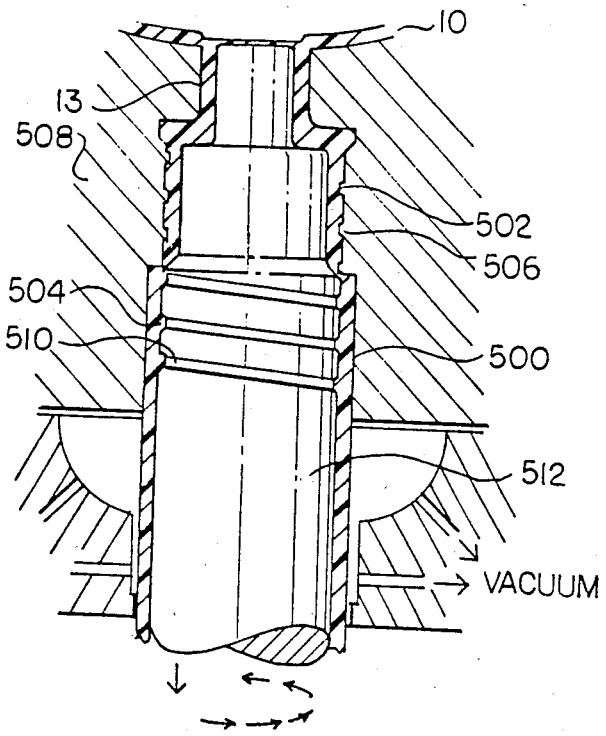
FIG. 14 of the drawings is a vertical section of an alternative embodiment of the mold and diaphragm pins shown in FIG. 5, used to manufacture a port having a twist cap integrally formed thereon and frangible connected together.

As best seen in FIG. 14 of the drawings, in an alternative embodiment, container 10 may be formed having a twist cap 500 fringibly attached to port 13; with female threads 502 formed about port 13 and male threads 504 formed within cap 500. Female threads 502 are formed by corresponding threading 506 in mold 508. Male threads 504 are formed within cap 500 through threading 510 on adjustable diaphragm pin 512. Diaphragm pin 512 differs in operationg from diaphragm pin 212 (FIG. 5) in that it is unscrewed out of mold 508 after port 13 and cap 500 are initially formed.

Once diaphragm pin 512 is removed, twist cap 500 may be compressed together at end 514 so as to be sealed, similar to the method disclosed in FIGS. 5 through 8. Port 13 thereby remains sealed until ready for use.

Figure 15:
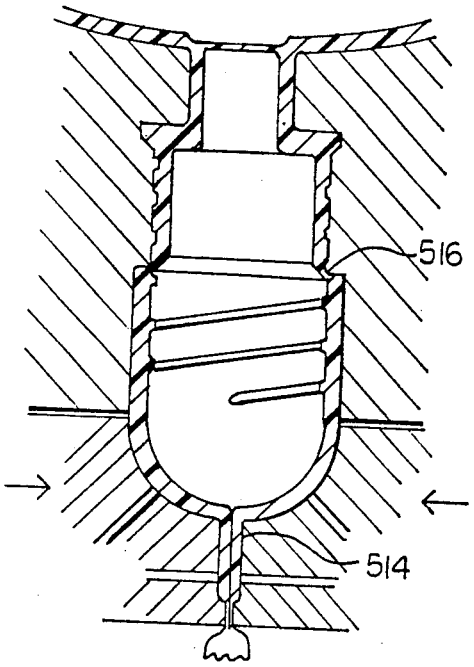
FIG. 15 of the drawings is a vertical section of the port and twist cap disclosed in FIG. 14.
Figure 16:
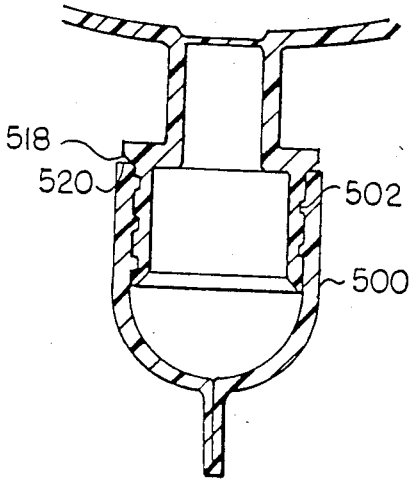
FIG. 16 of the drawings is a vertical section of the port and twist cap disclosed in FIG. 15 showing in particular the twist cap broken from the port and then threadedly attached thereto.

As best seen in FIGS. 14–16, frangible or weakened portion 516 is formed at the juncture between tubular port 13 and twist cap 500. In use frangible portion 516 is broken and twist cap 500 removed to allow access to the interior of port 13. Port 13 may then be resealed as desired simply by threading twist cap 500 onto threaded portion 502 of port 13. Alternatively, twist cap 500 may be formed separately from port 13, and attached in a subsequent operation. It should however be noted that the inside diameter of twist cap 500 is larger than the outside diameter of tubular port 13, in order to allow joinder and at the same time removal of diaphragm pin 512. As an additional feature, sealing taper 518 may be formed about port 13, so that when twist cap 500 is threadedly attached a hermetic seal may be formed between the top 520 of cap 500 and sealing taper 518.

The foregoing description and drawings merely explain and illustrate the invention, and the invention is not limited thereto, except in so far as the appended claims are limited by those skilled in the art who have the disclosure before them and are able to make modifications and variations therein without departing from the scope of the invention.

We claim:

1. A container having a quantity of liquid therein comprising:

a hollow body formed of a plastic material;

at least one tubular port integrally formed in and extending from said hollow body; each said port having a quantity of said plastic material integrally formed as a diaphragm within said port so as to seal said port;

a resealable septum member fixedly attached and sealed within at least one said tubular port, said diaphragm being positioned between said resealable septum and said liquid so as to prevent deterioration of said resealable septum from exposure to said liquid; said resealable septum and said diaphragm being adapted for penetration by a hypodermic needle;

a removable twist cap member integrally formed about and sealing the end of at least one said tubular port; and frangible groove means circumscribing said tubular port for facilitating the separation and removal of said twist cap member from said tubular port.

2. A container having a quantity of liquid therein comprising:

a hollow body formed of a plastic material;

at least one tubular port integrally formed in and extending from said hollow body, each said port having a quantity of said plastic material integrally formed as a diaphragm within said port so as to seal said port;

a resealable septum member fixedly attached and sealed within at least one said tubular port, said diaphragm being positioned between said resealable septum and said liquid so as to prevent deterioration of said resealable septum from exposure to said liquid; said resealable septum and said diaphragm being adapted for penetration by a hypodermic needle;

a removable twist cap member attached to and sealing the end of at least one said tubular port; and a frangible portion of said tubular port circumscribing said tubular port with said twist cap member for facilitating the separation and removal of said twist cap member from said tubular port.

3. The container according to claim 1 or 2 wherein said tubular port includes an enlarged diameter at the free end for facilitating insertion of said hypodermic needle into said tubular port without contamination of said hypodermic needle or said tubular port and said twist cap member extending outwardly from said enlarged diameter.

4. The container according to claim 1 further including a plurality of said tubular ports and twist cap member with tab members integrally formed and extending from said twist cap members for facilitating the manual rotation of said twist cap members whereby said frangible groove means may be severed and said twist cap separated therefrom.

5. The invention according to claim 1 or 2 in which at least one said tubular port is formed about said resealable septum so as to provide improved sealability between said septum and said tubular port.

6. The invention according to claim 1 in which said hollow body is substantially tubular in shape, tapering to a hanger portion at one end and having at least one of said tubular ports at a second end, said hollow body being adapted to uniformly collapse from said hanger portion downward upon dispersal of said liquid from said container.

7. The invention according to claim 1 in which said container comprises a blow molded bag.

8. The invention according to claim 1 in which said container is sterilizable and sterility maintaining.

9. A container having a quantity of liquid therein comprising:

a hollow body formed of a plastic material;

at least one tubular port integrally formed and extending from said hollow body, each said port having a quantity of plastic material formed as a diaphragm within said port so as to seal said port;

a resealable septum member fixedly attached and sealed within at least one said tubular port, said diaphragm being positioned between said resealable septum and said liquid, so as to prevent deterioration of said resealable septum from exposure to said liquid, said resealable septum and said diaphragm being adapted for penetration by said hypodermic needle; and a tubular cap member, closed at a first end, insertable into and removable from at least one said tubular port for the selective sealing of said tubular port.

10. The container according to claim 9 in which each said tubular cap member comprises a first tubular member having an outside diameter slightly smaller than the inside diameter of each said tubular port so as to permit forceable insertion therein and an overcap member fitted about and closing said closed first end of each said tubular cap member, for the hermetic sealing thereof.

11. The container according to claim 10 in which each said overcap comprises a penetrable resealable elastomeric material so as to facilitate insertion of a hypodermic syringe therethrough.

12. The container according to claim 10 in which said overcap comprises a substantially rigid thermoplastic material so as to facilitate the removal of said overcap from said tubular cap.

13. The container according to claim 9 or 12 in which each said tubular cap member further include tab means attached thereto for facilitating removal of said cap member from said tubular port.

* * * * *